US012325952B2

(12) United States Patent
Hishida et al.

(10) Patent No.: US 12,325,952 B2
(45) Date of Patent: Jun. 10, 2025

(54) NAPPED ARTIFICIAL LEATHER AND METHOD FOR PRODUCING THE SAME

(71) Applicant: KURARAY CO., LTD., Kurashiki (JP)

(72) Inventors: Hiroyuki Hishida, Okayama (JP); Kimio Nakayama, Okayama (JP); Masashi Meguro, Okayama (JP)

(73) Assignee: KURARAY CO., LTD., Kurashiki (JP)

( * ) Notice: Subject to any disclaimer, the term of this patent is extended or adjusted under 35 U.S.C. 154(b) by 393 days.

(21) Appl. No.: 17/757,785

(22) PCT Filed: Dec. 3, 2020

(86) PCT No.: PCT/JP2020/045141

§ 371 (c)(1),
(2) Date: Jun. 21, 2022

(87) PCT Pub. No.: WO2021/131591

PCT Pub. Date: Jul. 1, 2021

(65) Prior Publication Data

US 2023/0340723 A1 Oct. 26, 2023

(30) Foreign Application Priority Data

Dec. 25, 2019 (JP) ..... 2019-234821

(51) Int. Cl.
*D06N 3/00* (2006.01)

(52) U.S. Cl.
CPC ..... *D06N 3/0004* (2013.01); *D06N 3/0011* (2013.01); *D06N 3/0027* (2013.01); *D06N 3/0065* (2013.01); *D06N 3/0075* (2013.01); *D06N 3/0077* (2013.01); *D06N 2209/0823* (2013.01)

(58) Field of Classification Search
None
See application file for complete search history.

(56) References Cited

U.S. PATENT DOCUMENTS

| | | | | |
|---|---|---|---|---|
| 11,873,606 | B2 | 1/2024 | Hattori et al. | |
| 2004/0063366 | A1 | 4/2004 | Nakayama et al. | |
| 2004/0242099 | A1* | 12/2004 | Yoshimoto | D04H 1/4383 442/59 |
| 2006/0182922 | A1* | 8/2006 | Ishida | C08G 18/0828 428/44 |
| 2010/0047531 | A1 | 2/2010 | Baum et al. | |
| 2021/0032807 | A1 | 2/2021 | Nakayama et al. | |
| 2022/0018061 | A1 | 1/2022 | Hishida et al. | |
| 2023/0147237 | A1 | 5/2023 | Matsuda et al. | |
| 2023/0416982 | A1 | 12/2023 | Ashida et al. | |

FOREIGN PATENT DOCUMENTS

| | | |
|---|---|---|
| CN | 102002867 | 4/2011 |
| JP | S59-21903 | 5/1984 |
| JP | 2004-137619 | 5/2004 |
| JP | 2004-143654 | 5/2004 |
| JP | 2005-154971 A | 6/2005 |
| JP | 2008-524453 | 7/2008 |
| JP | 2013-75366 A | 4/2013 |
| JP | 2017-133114 A | 8/2017 |
| JP | 2019-1129 A | 1/2019 |
| WO | 2019/159728 | 8/2019 |

OTHER PUBLICATIONS

International Search Report dated Mar. 2, 2021, in PCT/JP2020/045141 with English translation, 5 pages.
Written Opinion dated Mar. 2, 2021, in PCT/JP2020/045141, 3 pages.
Office Action received for U.S. Appl. No. 17/907,687, mailed on Feb. 3, 2025, 13 pages.
U.S. Appl. No. 17/907,687, filed Sep. 29, 2022, Patent Publication No. 2023/0147237, Matsuda et al.

* cited by examiner

*Primary Examiner* — Sheeba Ahmed
(74) *Attorney, Agent, or Firm* — Grüneberg and Myers PLLC

(57) ABSTRACT

A napped artificial leather includes: a fiber-entangled body obtained by entangling ultrafine fibers; and an elastic polymer impregnated into the fiber-entangled body. The napped artificial leather has, on at least one side thereof, a napped surface formed by napping the ultrafine fibers. The ultrafine fibers contain 0.2 to 8 mass % of carbon black and 0.1 to 5 mass % of a chromatic pigment, and a total ratio of the carbon black and the chromatic pigment is 0.3 to 10 mass %. A content ratio of the elastic polymer is 0.1 to 15 mass % in the napped artificial leather. The elastic polymer is uncolored and the ultrafine fibers are undyed.

18 Claims, No Drawings

NAPPED ARTIFICIAL LEATHER AND METHOD FOR PRODUCING THE SAME

CROSS-REFERENCE TO RELATED APPLICATIONS

This application is the National Stage entry under § 371 of International Application No. PCT/JP2020/045141, filed on Dec. 3, 2020, and which claims the benefit of priority to Japanese Application No. 2019-234821, filed on Dec. 25, 2019. The content of each of these applications is hereby incorporated by reference in its entirety.

TECHNICAL FIELD

The present invention relates to a napped artificial leather that has a napped surface similar to that of a suede leather and that can be suitably used as a surface material for clothing, shoes, articles of furniture, car seats, and general merchandise, and the like. More specifically, the invention relates to a napped artificial leather that can be colored in a wide variety of colors ranging from a light color to a dark color while maintaining a high color fastness.

BACKGROUND ART

Napped artificial leathers having an appearance similar to that of a suede leather have a napped surface with raised ultrafine fibers that is formed by napping the surface of an artificial leather gray fabric produced by impregnating an elastic polymer into voids of a fiber-entangled body obtained by entangling ultrafine fibers.

In order to color a napped artificial leather, dyeing is widely performed. In the case of using dyeing, a napped artificial leather can be colored in a wide variety of colors ranging from a light color to a dark color. However, a dyed napped artificial leather has the problem of a low color fastness (e.g., color fastness to rubbing). In addition, in a dyed napped artificial leather, the color fastness of the elastic polymer is lower than that of the ultrafine fibers. This poses a problem that a portion of the napped surface where the elastic polymer is exposed becomes whitish, which makes color unevenness due to the difference in color between the ultrafine fibers and the elastic polymer conspicuous, thus creating a dichromatic impression. Accordingly, it is difficult to obtain a napped artificial leather with a quality appearance There has also been proposed a method for producing a napped artificial leather that has an excellent color fastness, can suppress dichromatic impression, and whose color can be adjusted in a wide variety of color tones ranging from a vivid color tone to an achromatic color tone, and a light color tone to a dark color tone. For example, PTL 1 below discloses that fibers and an elastic polymer are both colored with pigments, thus mixing the color of the fibers and the color of the elastic polymer so as to be adjusted in a wide variety of color tones.

CITATION LIST

Patent Literature

[PTL 1] Japanese Laid-Open Patent Publication No. 2004-143654

SUMMARY OF INVENTION

Technical Problem

In the case where an elastic polymer is colored with a pigment in order to color a napped artificial leather, there is a problem that a portion of the pigment is detached in a coagulation step of the elastic polymer, resulting in color variations in products, or the loss due to raw material switching is increased when changing the color to a different color in the production process. On the other hand, in the case where the elastic polymer is not colored, there is a problem that a portion of the napped surface where the elastic polymer is exposed becomes whitish, which makes color unevenness due to the difference in color between the ultrafine fibers and the elastic polymer conspicuous, thus creating a dichromatic impression, as described above.

It is an object of the present invention to provide a napped artificial leather that is excellent in color fastness to rubbing, that can be colored in a wide variety of color tones ranging from a light color tone to a dark color tone, excluding a whitish tone, and that is less likely to give a dichromatic impression on a napped surface even when an elastic polymer is not colored.

Solution to Problem

An aspect of the present invention is directed to a napped artificial leather including: a fiber-entangled body obtained by entangling ultrafine fibers; and an elastic polymer impregnated into the fiber-entangled body, the napped artificial leather having, on at least one side thereof, a napped surface formed by napping the ultrafine fibers, wherein the ultrafine fibers contain 0.2 to 8 mass % of carbon black and 0.1 to 5 mass % of a chromatic pigment, and a total ratio of the carbon black and the chromatic pigment is 0.3 to 10 mass %, a content ratio of the elastic polymer is 0.1 to 15 mass %, and the elastic polymer is uncolored, and the ultrafine fibers are undyed. Such a napped artificial leather is undyed, and therefore is excellent in color fastness to rubbing. In addition, since the elastic polymer is uncolored, the problem of contamination occurring when the elastic polymer is colored with a pigment will not arise. Furthermore, since the content ratio of the elastic polymer is 0.1 to 15 mass %, the elastic polymer is less likely to be exposed on the napped surface, so that color unevenness is inconspicuous, and a dichromatic impression is thus less likely to be created. Moreover, since the ultrafine fibers are colored using 0.2 to 8 mass % of carbon black and 0.1 to 5 mass % of a chromatic pigment, the ultrafine fibers can be colored in a wide range of color tones excluding a whitish tone, and a dichromatic impression is less likely to be created on the napped surface. Also, since the total ratio of the carbon black and the chromatic pigment is 0.3 to 10 mass %, it is possible to achieve both the colorability and the melt spinnability during production.

It is preferable that a mass ratio of the chromatic pigment/the carbon black is 0.1 to 2.0, since a dichromatic impression is less likely to be created sufficiently.

It is preferable that the napped surface has a lightness L* value of 25 or less, an a* value in the range of −2.5 to 2.5, and a b* value in the range of −2.5 to 2.5 in a color coordinate space (L*a*b*color space), since the effect of making color unevenness inconspicuous becomes prominent, and a high color fastness to rubbing can be maintained even for a dark color.

Production of the above-described napped artificial leather may include a step in which an organic solvent is used, such as a step of removing a component of the island-in-the-sea conjugated fibers using an organic solvent, or a step of wet-coagulating the elastic polymer using a coagulation liquid containing an organic solvent. Such a production of the napped artificial leather is problematic in that the organic pigment blended in the island component is dissolved out during the step in which an organic solvent is used.

Another aspect of the present invention is directed to a method for producing the above-described napped artificial leather, including at least the steps of: preparing a fiber-entangled body of island-in-the-sea conjugated fibers including, as an island component, a water-insoluble thermoplastic resin containing 0.2 to 8 mass % of carbon black and 0.1 to 5 mass % of a chromatic pigment, and a water-soluble thermoplastic resin as a sea component; impregnating, into voids of the fiber-entangled body of the island-in-the-sea conjugated fibers, an aqueous liquid for forming an uncolored aqueous elastic polymer, and subsequently removing a part of the aqueous liquid by squeezing off; dry-coagulating the aqueous elastic polymer in the aqueous liquid impregnated into the voids of the fiber-entangled body of the island-in-the-sea conjugated fibers; removing by dissolution the water-soluble thermoplastic resin from the island-in-the-sea conjugated fibers using an aqueous solvent, thereby obtaining an artificial leather gray fabric including the fiber-entangled body of the ultrafine fibers of the water-insoluble thermoplastic resin; and napping at least one side of the artificial leather gray fabric by buffing, wherein the method does not include a step of dyeing the artificial leather gray fabric. Such a production method does not include a step of removing a component of the island-in-the-sea conjugated fibers using an organic solvent, or a step of wet-coagulating the elastic polymer dissolved in a solvent using a liquid containing an organic solvent, and therefore does not pose the problem of dissolution of the chromatic pigment blended in the island component.

Advantageous Effects of Invention

According to the present invention, it is possible to obtain a napped artificial leather that is excellent in color fastness to rubbing, that can be colored in a wide variety of color tones ranging from a light color tone to a dark color tone, excluding a whitish tone, and that is less likely to give a dichromatic impression on a napped surface even when an elastic polymer is not colored.

DESCRIPTION OF EMBODIMENT

A napped artificial leather according to the present embodiment is a napped artificial leather including: a fiber-entangled body obtained by entangling ultrafine fibers; and an elastic polymer impregnated into the fiber-entangled body, the napped artificial leather having, on at least one side thereof, a napped surface formed by napping the ultrafine fibers, wherein the ultrafine fibers contain 0.2 to 8 mass % of carbon black and 0.1 to 5 mass % of a chromatic pigment, and a total ratio of the carbon black and the chromatic pigment is 0.3 to 10 mass %, a content ratio of the elastic polymer is 0.1 to 15 mass %, and the elastic polymer is uncolored, and the ultrafine fibers are undyed. The napped artificial leather according to the present embodiment will now be described in detail, in conjunction with an exemplary production method thereof.

A napped artificial leather according to the present embodiment can be produced, for example, by a production method including at least the steps of: preparing a fiber-entangled body of island-in-the-sea conjugated fibers including, as an island component, a water-insoluble thermoplastic resin containing 0.2 to 8 mass % of carbon black and 0.1 to 5 mass % of a chromatic pigment, and a water-soluble thermoplastic resin as a sea component; impregnating, into voids of the fiber-entangled body of the island-in-the-sea conjugated fibers, an aqueous liquid for forming an uncolored aqueous elastic polymer, and subsequently removing a part of the aqueous liquid by squeezing off; dry-coagulating the aqueous elastic polymer in the aqueous liquid impregnated into the voids of the fiber-entangled body of the island-in-the-sea conjugated fibers; removing by dissolution the water-soluble thermoplastic resin from the island-in-the-sea conjugated fibers using an aqueous solvent, thereby obtaining an artificial leather gray fabric including the fiber-entangled body of the ultrafine fibers of the water-insoluble thermoplastic resin; and napping at least one side of the artificial leather gray fabric by buffing, wherein the method does not include a step of dyeing the artificial leather gray fabric. The ultrafine fibers in the present embodiment mean fibers made of an island component obtained by removing a sea component from island-in-the-sea conjugated fibers.

First, a description will be given of a step of preparing a fiber-entangled body of island-in-the-sea conjugated fibers including a water-insoluble thermoplastic resin including 0.2 to 8 mass % of carbon black and 0.1 to 5 mass % of a chromatic pigment as an island component, and a water-soluble thermoplastic resin as a sea component.

Examples of the production method of the entangle body of the island-in-the-sea conjugated fibers include a method in which island-in-the-sea conjugated fibers are melt spun to produce a web, and the web is subjected to entangling. Examples of the method for producing the web of island-in-the-sea conjugated fibers include a method in which island-in-the-sea conjugated fibers of filaments that have been spun by spunbonding or the like are collected on a net without being cut, to form a filament web, and a method in which filaments that have been melt-spun are cut into staples to form a staple web. Among these, it is particularly preferable to use a filament web, since the entangled state can be easily adjusted and a high level of fullness can be achieved. In addition, the formed web may be fusion bonded in order to impart shape stability thereto. In any of the processes until the sea component of the island-in-the-sea conjugated fibers is removed to form ultrafine fibers, fiber shrinking such as heat shrinking using water vapor or hot water, or using dry-heating may be performed to densify the island-in-the-sea conjugated fibers.

Note that the filament means a continuous fiber, rather than a staple that has been intentionally cut after being spun. Specifically, the filament means a filament or a continuous fiber other than a staple that has been intentionally cut so as to have a fiber length of about 3 to 80 mm, for example. The fiber length of the island-in-the-sea conjugated fibers before being subjected to the ultrafine fiber generation is preferably 100 mm or more, and may be several meters, several hundred meters, several kilometers, or more, as long as the fibers are technically producible and are not inevitably cut during the production processes.

The type of the water-insoluble thermoplastic resin that forms the island component in the island-in-the-sea conjugated fibers is not particularly limited. Specific examples thereof include aromatic polyesters including, for example, polyethylene terephthalate (PET), modified PETs such as an isophthalic acid-modified PET and a sulfoisophthalic acid-modified PET, a cationic dyeable PET, polybutylene terephthalate, and polyhexamethylene terephthalate; aliphatic polyesters such as polylactic acid, polyethylene succinate, polybutylene succinate, polybutylene succinate adipate, and a polyhydroxybutyrate-polyhydroxyvalerate resin; nylons such as nylon 6, nylon 66, nylon 10, nylon 11, nylon 12, and nylon 6-12; and polyolefins such as polypropylene, polyethylene, polybutene, polymethylpentene, and a chlorine-based polyolefin.

In the production method of the napped artificial leather according to the present embodiment, in order to color the ultrafine fibers, 0.2 to 8 mass % of carbon black and 0.1 to 5 mass % of a chromatic pigment are blended in the resin for the island component.

Specific examples of the carbon black include channel black, furnace black, thermal black, and ketjen black.

The chromatic pigment is a pigment that develops a chromatic color other than achromatic colors, which are black, gray and white, and is mainly an organic pigment. Specific examples of such a chromatic pigment include organic pigments including, for example, condensed polycyclic organic pigments including, for example, a phthalocyanine-based pigment such as Pigment Blue 15:3, which is a copper phthalocyanine β crystal, an anthraquinone-based pigment, a quinacridone-based pigment, a dioxazine-based pigment, an isoindolinone-based pigment, an isoindoline-based pigment, an indigo-based pigment, a quinophthalone-based pigment, a diketopyrrolopyrrole-based pigment, a perylene-based pigment, and a perinone-based pigment, and insoluble azo-based pigments such as a benzimidazolone-based pigment, a condensed azo-based pigment, and an azomethine azo-based pigment; and inorganic coloring pigments such as titanium oxide, red iron oxide, chrome red, molybdenum red, litharge, ultramarine blue, iron blue, and iron oxide. These chromatic pigments exhibit a chromatic color such as blue, red, green, and yellow.

If necessary, in addition to carbon black and the chromatic pigment, another pigment, an ultraviolet absorber, a heat stabilizer, a deodorant, an antifungal agent, various stabilizers, and the like may be blended in the ultrafine fibers, as long as the effects of the present invention are not impaired.

The method for blending carbon black and the chromatic pigment in the resin for the island component is not particularly limited. Specific examples thereof include a method in which a water-insoluble thermoplastic resin for forming the island component that constitutes the ultrafine fibers, carbon black, and the chromatic pigment are kneaded using compounding equipment such as an extruder so as to attain the above-described content ratio.

The ratio of the carbon black contained in the ultrafine fibers formed is 0.2 to 8 mass %, preferably 0.5 to 5 mass %, and more preferably 1 to 3 mass %, since a dark-color napped artificial leather is likely to be obtained. When the content ratio of the carbon black in the ultrafine fibers is less than 0.2 mass %, the color development properties are deteriorated, resulting in a whitish tone and hence a coloration that is inferior in terms of the quality appearance. When the content ratio of the carbon black exceeds 8 mass %, the coloration of the chromatic color due to the chromatic pigment is less noticeable, resulting in a reduction in the effect of reducing the dichromatic impression. In addition, the spinnability and the physical properties tend to be reduced significantly.

The ratio of the chromatic pigment contained in the ultrafine fibers formed is 0.1 to 5 mass %, preferably 0.5 to 4 mass %, and more preferably 1 to 3 mass %, since the napped artificial leather can be colored in a wide variety of color tones ranging from a light color tone to a dark color tone, and the dichromatic impression is likely to be reduced. When the content ratio of the chromatic pigment contained in the ultrafine fibers is less than 0.1 mass %, the chromatic coloration due to the chromatic pigment is less likely to be achieved, so that the dichromatic impression is less likely to be reduced. When the content ratio of the chromatic pigment contained in the ultrafine fibers exceeds 5 mass %, the stability in spinning is likely to be reduced due to an excessive amount of the chromatic pigment.

The total ratio of the carbon black and the chromatic pigment contained in the ultrafine fibers formed is 0.3 to 10 mass %, and preferably 0.5 to 9 mass %. When the total ratio of the carbon black and the chromatic pigment exceeds 10 mass %, the melt spinnability is reduced, resulting in a reduced productivity. When the total ratio of the carbon black and the chromatic pigment is less than 0.3 mass %, the colorability is reduced.

As for the ratio between the carbon black and the chromatic pigment contained in the ultrafine fibers formed, the mass ratio of the chromatic pigment/the carbon black is preferably 0.1 to 2.0, and more preferably 0.25 to 1.0. When the mass ratio of the chromatic pigment/the carbon black is less than 0.1, the chromatic coloration due to the chromatic pigment is less likely to be obtained, so that the dichromatic impression is less likely to be reduced. When the mass ratio of the chromatic pigment/the carbon black exceeds 2.0, the color development properties tend to be deteriorated.

As the water-soluble thermoplastic resin serving as the sea component of the island-in-the-sea conjugated fibers, a water-soluble thermoplastic resin having higher solubility in a solvent or higher decomposability by a decomposition agent than the resin for the island component is selected. Also, a water-soluble thermoplastic resin having low affinity for the water-insoluble thermoplastic resin serving as the island component, and a smaller melt viscosity and/or surface tension under the spinning condition than the water-insoluble thermoplastic resin is preferable in terms of the excellent stability in spinning of the island-in-the-sea conjugated fibers. As a specific example of such a water-soluble thermoplastic resin, a water-soluble polyvinyl alcohol-based resin (water-soluble PVA) is preferable in that it can be removed by dissolution using an aqueous medium, without using an organic solvent.

The fineness of the island-in-the-sea conjugated fibers is not particularly limited. The average area ratio (sea component/island component) between the sea component and the island component on the cross section of the island-in-the-sea conjugated fiber is preferably 5/95 to 70/30, and more preferably 10/90 to 50/50. The number of domains of the island component on the cross section of the island-in-the-sea conjugated fiber is not particularly limited, but is preferably about 5 to 1000, and more preferably about 10 to 300, from the viewpoint of the industrial productivity.

Examples of the entangling include a method in which the web is laid in a plurality of layers in the thickness direction using a cross lapper or the like, and subsequently the web is needle punched simultaneously or alternately from both sides thereof such that at least one barb penetrates the web, or a method in which the web is subjected to entangling by high-pressure water jetting. Note that an oil solution, an antistatic agent, and the like may be added to the web in any stage from the spinning step to the entangling of the island-in-the-sea conjugated fibers.

Then, if necessary, fiber shrinking such as heat shrinking using water vapor or hot water, or dry-heating, or hot pressing is performed on the entangled web to adjust the entangled state and the smoothed state of the web, whereby a non-woven fabric that is an entangle body of the island-in-the-sea conjugated fibers can be obtained.

Next, a description will be given of a step of impregnating, into voids of the entangle body of the island-in-the-sea conjugated fibers, an aqueous liquid for forming an aqueous elastic polymer, and subsequently removing a part of the aqueous liquid by squeezing off, thereby adjusting the content ratio of the elastic polymer to 0.1 to 15 mass %. The elastic polymer is a component that imparts shape stability to the napped artificial leather.

In the present step, an aqueous liquid for forming an aqueous elastic polymer is impregnated into voids of the entangle body of the island-in-the-sea conjugated fibers, and subsequently the aqueous liquid is appropriately squeezed off, for example, by performing roll-nip treatment. Here, the aqueous elastic polymer means an elastic polymer that is prepared in the form of an aqueous liquid such as an emulsion, a dispersion, and a suspension by being dissolved in an aqueous medium composed mainly of water through self-emulsification, forced emulsification, suspension, or the like.

Specific examples of the elastic polymer that is prepared in the form of an aqueous liquid include polyurethane, an acrylonitrile elastomer, an olefin elastomer, a polyester elastomer, a polyamide elastomer, and an acrylic elastomer. Among these, polyurethane is preferable. The elastic polymer is not colored, and therefore contains substantially no pigment. However, the elastic polymer may contain a pigment in a range that the elastic polymer is substantially uncolored, which is a range that any influence resulting from contamination by the pigment is not imposed on the manufacturing process, specifically, in the range of 0 to 0.01 mass %.

That is, the content ratio of the pigment in the elastic polymer is preferably 0 to 0.01 mass %, more preferably 0 to 0.005 mass %, and particularly preferably 0 mass %, since the elastic polymer is substantially uncolored, so that any influence resulting from contamination is not imposed on the manufacturing process. When the content ratio of the pigment in the elastic polymer exceeds 0.01 mass %, the elastic polymer is colored, and the pigment may remain to such an extent that an influence resulting from contamination is imposed on the manufacturing process. In that case, the productivity tends to be reduced when the napped artificial leather is produced under multiple brands in small quantities.

In the aqueous liquid of the elastic polymer, if necessary, a coagulation regulator such as a gelling agent, an antioxidant, an ultraviolet absorber, a fluorescent agent, an antifungal agent, a penetrant, an antifoaming agent, a lubricant, a water-repellent agent, an oil-repellent agent, a thickener, a filler, a curing accelerator, a foaming agent, a water-soluble polymer compound such as polyvinyl alcohol or carboxymethyl cellulose, inorganic fine particles, a conductive agent and the like may be blended. In particular, when the content ratio of the elastic polymer is adjusted to 0.1 to 15 mass %, in order for the elastic polymer to be less likely to be exposed on the napped surface, it is particularly preferable to include a heat-sensitive gelling agent that causes gelation of the aqueous liquid of the elastic polymer.

Specific examples of the heat-sensitive gelling agent include zinc oxide, potassium sulfate, sodium sulfate, an alkylene oxide adduct of an alkylphenol formalin condensate, polyether formal, polyvinyl methyl ether, polypropylene glycol, a polyalkylene oxide-modified polysiloxane, a water-soluble polyamide, starch, methylcellulose, hydroxy ethylcellulose, carboxymethyl cellulose, protein, carbonate, bicarbonate, and polyphosphate. The content ratio of the heat-sensitive gelling agent depends on the type of the heat-sensitive gelling agent, but is preferably 0.01 to 30 parts by mass per 100 parts by mass of the elastic polymer (solid content).

In the present step, the aqueous liquid of the elastic polymer is impregnated into the voids of the entangle body of the island-in-the-sea conjugated fibers, and subsequently the aqueous liquid is appropriately squeezed off, for example, by performing roll-nip treatment. Thus, the content ratio of the elastic polymer contained in the obtained napped artificial leather is adjusted to 0.1 to 15 mass %. By adjusting the content ratio of the elastic polymer contained in the napped artificial leather to 0.1 to 15 mass %, the uncolored elastic polymer is less likely to be exposed on the napped surface of the napped artificial leather, thus making color unevenness inconspicuous. When the content ratio of the elastic polymer contained in the napped artificial leather exceeds 15 mass %, the uncolored elastic polymer is likely to be exposed on the napped surface of the napped artificial leather, so that color unevenness is conspicuous, and a dichromatic impression is likely to be sensed.

Then, the elastic polymer in the aqueous liquid applied into the voids of the entangle body of the island-in-the-sea conjugated fibers is coagulated. Examples of the method for coagulating the elastic polymer from the aqueous liquid include a method in which the entangle body of the island-in-the-sea conjugated fibers into which the aqueous liquid has been impregnated is dried at a temperature of about 120 to 170° C. When the aqueous liquid is an emulsion, it is preferable to suppress migration of the aqueous liquid to the surface layer by gelling the aqueous liquid through heat moisture treatment, followed by drying.

Then, the sea component is removed from the island-in-the-sea conjugated fibers, thereby generating an artificial leather gray fabric including the fiber-entangled body of the ultrafine fibers. Examples of the method for removing the sea component from the island-in-the-sea conjugated fibers include a method in which the sea component in the island-in-the-sea conjugated fibers is removed by dissolution or decomposition using a solvent or a decomposition agent capable of selectively removing only the sea component.

The ultrafine fibers have an average fineness of preferably 1.5 dtex or less, more preferably 0.005 to 1 dtex, and particularly preferably 0.1 to 0.5 dtex. When the average fineness of the ultrafine fibers is too high, the density of the napped surface tends to be reduced, making it impossible to obtain a quality appearance, or the flexible texture tends to be reduced. Here, the fineness is determined by imaging a cross section of the napped artificial leather that is parallel to the thickness direction thereof using a scanning electron microscope (SEM) at a magnification of 3000×, calculating an average value of the diameters of 15 evenly elected fibers and calculating the fineness by using the density of the resin that forms the fibers.

The thus obtained artificial leather gray fabric includes the fiber-entangled body of the ultrafine fibers, and the elastic polymer impregnated into the entangle body of the ultrafine fibers. If necessary, the artificial leather gray fabric may be finished into an artificial leather gray fabric having a predetermined thickness by being sliced in the thickness direction to adjust the thickness thereof.

Then, by buffing at least one side of the artificial leather gray fabric, a napped artificial leather in which the ultrafine fibers on the surface are napped is obtained. Examples of the buffing method include a method in which buffing is performed using sandpaper or emery paper with a grit number of preferably about 120 to 600, and more preferably about 240 to 600. Thus, a napped artificial leather having a napped surface on which napped ultrafine fibers are present on one side or both sides is obtained.

The napped artificial leather may be further subjected to shrinkage processing or flexibilizing treatment by crumpling to impart flexibility for adjusting the texture, or finishing such as reverse seal brushing, antifouling treatment, hydrophilization treatment, lubricant treatment, softener treatment, antioxidant treatment, ultraviolet absorber treatment, fluorescent agent treatment, and flame retardancy treatment.

If necessary, to the surface layer of the napped surface of the artificial leather gray fabric, an elastic polymer may be further applied so as to constrain the bases of the napped fibers in order to inhibit the napped fibers from falling out, thus improving the appearance quality and the physical properties of the napped surface. Examples of the method for applying the elastic polymer so as to constrain the bases of the napped fibers include a method in which an aqueous dispersion of the elastic polymer or a solvent-based solution of the elastic polymer is gravure coated from the napped surface side.

In the case of applying the elastic polymer to the napped surface of the artificial leather gray fabric, the amount of application as a solid content is preferably 0.2 to 4 g/m$^2$, and more preferably 0.5 to 3 g/m$^2$, from the viewpoint of achieving excellent balance between the quality appearance and the pilling resistance of the napped surface. The ratio of the amount of application, as a solid content, of the elastic polymer to the napped surface is preferably 0.1 to 1.0 mass %, and more preferably 0.15 to 0.8 mass %, from the viewpoint of achieving excellent balance between the quality appearance and the pilling resistance of the napped surface.

The thus produced napped artificial leather according to the present embodiment is colored, with the carbon black and the chromatic pigment blended in the ultrafine fibers, in the intended color within a wide variety of colors, ranging from a light color to a dark color. Furthermore, with the napped artificial leather according to the present embodiment, it is possible to make color unevenness inconspicuous since the elastic polymer is less likely to be exposed on the napped surface, and also to achieve a high coloring fastness and excellent productivity.

Although the color of the napped surface of the napped artificial leather according to the present embodiment is not particularly limited, it is particularly preferable that the lightness L* value in a color coordinate space (L*a*b*color space) of the napped surface is preferably 25 or less, and more preferably 17 or less, from the viewpoint of achieving a significant effect of making color unevenness inconspicuous due to the elastic polymer being less likely to be exposed on the napped surface. It is preferable that the a* value is in the range of −2.5 to 2.5, and the b* value is in the range of −2.5 to 2.5, from the viewpoint of maintaining a high fastness even when the napped surface has a dark color.

Note that conventional napped artificial leathers are often colored by being dyed, whereas the napped artificial leather of the present embodiment is an undyed napped artificial leather that has not been dyed. Since the napped artificial leather is not dyed, it is possible to omit a dyeing step. Furthermore, since the elastic polymer is not colored, it is possible to omit an operation for switching the concentrations of the pigment in the aqueous liquid of the elastic polymer for each brand when the napped artificial leather is required to be produced under multiple brands in small quantities. Moreover, since the elastic polymer is uncolored, and the ultrafine fibers are undyed, it is possible to obtain a napped artificial leather that is less likely to cause the color of the dye to migrate to another fabric when rubbed thereagainst, and thus is excellent in color fastness to rubbing.

The thickness of the napped artificial leather produced in the above-described manner is not particularly limited, but is preferably 0.3 to 1.5 mm, and more preferably 0.4 to 1.0 mm. The basis weight of the napped artificial leather is also not particularly limited, but is preferably 150 to 600 g/m$^2$, and more preferably 200 to 500 g/m$^2$.

Furthermore, the apparent density of the napped artificial leather is also not particularly limited, but is preferably 0.4 to 0.7 g/cm$^3$, and more preferably 0.45 to 0.6 g/cm$^3$, since a napped artificial leather that is excellent in balance between the fullness and the flexible texture can be obtained.

EXAMPLES

Hereinafter, the present invention will be described more specifically by way of examples. It should be appreciated that the scope of the present invention is by no means limited by the examples.

Example 1

A thermoplastic, water-soluble polyvinyl alcohol (PVA) was prepared as a sea component, and an isophthalic acid-modified polyethylene terephthalate (IP-modified PET) to which 1.5 mass % of carbon black and 1.0 mass % in total of a chromatic pigment including a phthalocyanine-based organic blue pigment (copper phthalocyanine β crystal, Pigment Blue 15:3) and a dioxazine-based organic purple pigment had been added was prepared as an island component. Using a multicomponent melt-spinning spinneret (number of islands: 12 per one island-in-the-sea conjugated fiber), these components were discharged at a spinneret temperature set at 260° C., while adjusting the pressure such that the mass ratio of the sea component/the island component was 25/75. Then, the discharged melt strands were drawn, thereby spinning island-in-the-sea conjugated fibers having a fineness of 3.3 dtex.

Then, the island-in-the-sea conjugated fibers were continuously piled on a movable net, and lightly pressed with a metal roll heated to suppress fuzzing on the surface. Then, the island-in-the-sea conjugated fibers were separated from the net, and allowed to pass between the heated metal roll and a back roll while being pressed. Thus, a web having a basis weight of 32 g/m$^2$ was produced.

The obtained web was laid in 12 layers using a cross lapper apparatus so as to have a total basis weight of 380 g/m$^2$, to form a superposed web, and an oil solution for preventing the needle from breaking was uniformly applied thereto using a spray. Then, the superposed web was needle punched alternately from both sides at a density of 3300 punch/cm$^2$, to obtain an entangled web. The entangled web has a basis weight of 500 g/m$^2$. Then, the entangled web was treated for 30 seconds at 70° C. and a humidity of 50% RH, to cause heat-moisture shrinking. Thus, a fiber-entangled body of the island-in-the-sea conjugated fibers was produced.

Then, the fiber-entangled body of the island-in-the-sea conjugated fibers was impregnated with a polyurethane emulsion containing no pigment. The polyurethane emulsion was an emulsion containing 15 mass % of a self-emulsified amorphous polycarbonate-based polyurethane having a 100, modulus of 3.0 MPa as a solid content, and containing 2.5 mass % of ammonium sulfate as a heat-sensitive gelling agent. Then, the fiber-entangled body of the island-in-the-sea conjugated fibers impregnated with the polyurethane emulsion was allowed to pass through a clearance of a nip roll, thus squeezing off the emulsion.

Then, the emulsion that had been applied into the fiber-entangled body of the island-in-the-sea conjugated fibers was gelled by heat moisture treatment, and subsequently dried at 150° C., to coagulate the aqueous polyurethane. Then, the fiber-entangled body of the island-in-the-sea conjugated fibers in which the aqueous polyurethane had been coagulated was repeatedly dip-nipped in hot water at 95° C., to remove the PVA, and subsequently dried. Thus, a fiber-entangled body of ultrafine fibers in which fiber bundles each including 12 ultrafine fibers having a fineness of 0.2 dtex are three-dimensionally entangled was generated. Thus, an artificial leather gray fabric in which 10 mass % of the aqueous polyurethane had been applied into the voids of the fiber-entangled body of the ultrafine fibers was obtained.

Then, the artificial leather gray fabric was halved in the thickness direction, and the surface opposite to the sliced surface was buffed, to form a napped surface. Then, to the artificial leather gray fabric with the napped surface formed thereon, an aqueous dispersion of a polycarbonate-based polyurethane was gravure coated such that the application ratio was 0.7 mass % as a solid content, and subsequently dried at 135° C. Then, the artificial leather gray fabric was subjected to flexibilizing treatment using a jet dyeing machine containing no dye, and was further subjected to drying and brushing, to obtain a suede-like napped artificial leather. The obtained napped artificial leather had a bluish black color, and had a basis weight of 230 g/m$^2$ and an apparent density of 0.48 g/cm$^3$.

Then, the obtained napped artificial leather was evaluated according to the following evaluation methods.

<Chromaticity>

The chromaticity in the L*a*b*color system of the surface of the cut-out napped artificial leather was measured in accordance with JIS Z 8729, using a spectrocolorimeter (CM-3700 manufactured by Minolta). The average value of the chromaticity of measured values for three points evenly selected from average positions of the test piece was calculated. The smaller the L* value, the higher the hyperchromicity is.

<Color Unevenness>

A sample measuring 50 centimeters per side cut out from each napped artificial leather was prepared, and five expert evaluators determined whether or not there was a dichromatic impression. Then, the sample was evaluated as "A" when the majority of the evaluators determined that there was no dichromatic impression, and the sample was evaluated as "B" when the majority of the evaluators determined that there was a dichromatic impression.

<Melt Spinnability>

A: During melt spinning, fiber breakage hardly occurred, and continuous productivity was provided.

B: During melt spinning, fiber breakage or the like frequently occurred, and continuous productivity was not provided.

<Color Fastness to Rubbing>

A multifiber test fabric (co-woven fabric No. 1) prescribed in JIS L 0803 Annex JA and in which woven fabrics of cotton, nylon, acetate, wool, rayon, acrylic, silk, and polyester were woven so as to be parallel to each other was prepared. Then, the color fastness to rubbing in a dry state and a wet state was measured in accordance with JIS L 0849 (Test methods for color fastness to rubbing).

Specifically, using an Atlas clockmeter CM-5 (manufactured by ATLAS ELECTRIC DEVICES CO), the color fastness to rubbing was measured as follows.

For the color fastness to rubbing in a dry state, a dry multifiber test fabric was attached to a friction element made of glass. Then, the multifiber test fabric attached to the friction element was moved back and forth 10 times while being brought into contact with the napped surface of a cut piece of the napped artificial leather under a load of 900 g. Then, the multifiber test fabric was removed, then CELLOTAPE (registered trademark) was attached to the contaminated portion of the multifiber test fabric, and a columnar load of 1.5 ponds was rolled thereon in one reciprocating movement. Thereafter, the CELLOTAPE was detached from the multifiber test fabric.

On the other hand, for the color fastness to rubbing in a wet state, a wetted multifiber test fabric that had been immersed in distilled water and from which excess water had been thereafter removed was attached to a friction element made of glass. Then, the multifiber test fabric attached to the friction element was moved back and forth 10 times while being brought into contact with the napped surface of a cut piece of the napped artificial leather under a load of 900 g. Then, the multifiber test fabric was removed, and dried in an environment at 60° C. or less. Then, CELLOTAPE was attached to the contaminated portion of the multifiber test fabric, and a columnar load of 1.5 ponds was rolled thereon in one reciprocating movement. Thereafter, the CELLOTAPE was detached from the multifiber test fabric.

Then, the change in color migration to a white cotton fabric in a dry state and a wet state was evaluated using a Grey scale for assessing staining (grades 5 to 1). The grade was determined using the Grey scale for assessing staining for each of the woven fabrics, and the grade of the woven fabric made of the most stained material was used as the grade of the color migration resistance.

<Appearance>

A test piece of 20 cm×20 cm was cut out from the napped artificial leather. Then, the appearance of the surface of the test piece as observed visually was evaluated according to the following criteria.

A: Granular whitened spots or black spots of the elastic polymer were not confirmed when observed visually.

B: Granular whitened spots or black spots of the elastic polymer were confirmed when observed visually.

<Tactile Impression>

A test piece of 20 cm×20 am was cut out from the napped artificial leather. Then, the tactile impression of the surface of the test piece was evaluated in accordance with the following criteria.

A: A smooth tactile impression was observed.

B: The surface had a rough tactile impression.

The results are shown in Table 1.

TABLE 1

| Example No. | | 1 | 2 | 3 | 4 | 5 | 6 | 7 | 8 | 9 | 10 | 11 |
|---|---|---|---|---|---|---|---|---|---|---|---|---|
| Ultrafine fibers | Resin Type | IP-modified PET | | | | | | | | | | |
| | Fineness (dtex) | 0.2 | 0.2 | 0.2 | 0.2 | 0.2 | 0.1 | 0.3 | 0.3 | 1.5 | 0.2 | 0.2 |

TABLE 1-continued

| | | | | | | | | | | | | |
|---|---|---|---|---|---|---|---|---|---|---|---|---|
| | Carbon black content ratio (mass %) | 1.5 | 0.5 | 5 | 1.5 | 1.5 | 1.5 | 1.5 | 0.5 | 1.5 | 1.5 | 1.5 |
| | Type of chromatic pigment | Phthalocyanine-based organic blue pigment + Dioxazine-based organic purple pigment | | | | | | | | | | |
| | Chromatic pigment content ratio (mass %) | 1.0 | 0.3 | 3.3 | 0.3 | 3.0 | 1.0 | 1.0 | 0.3 | 1.0 | 1.0 | 1.0 |
| | Mass ratio of Chromatic pigment/CB | 0.67 | 0.67 | 0.67 | 0.2 | 2 | 0.67 | 0.67 | 0.67 | 0.67 | 0.67 | 0.67 |
| | Total ratio of carbon black and chromatic pigment (mass %) | 2.5 | 0.8 | 8.3 | 1.8 | 4.5 | 2.5 | 2.5 | 0.8 | 2.5 | 2.5 | 2.5 |
| Elastic polymer | Type | Aqueous polyurethane | | | | | | | | | | |
| | Content ratio (%) | 10 | 10 | 10 | 10 | 10 | 10 | 10 | 10 | 10 | 1 | 15 |
| | Carbon black content ratio (mass %) | 0 | 0 | 0 | 0 | 0 | 0 | 0 | 0 | 0 | 0 | 0 |
| Color | Color tone | Bluish black | Bluish gray | Bluish pitch black | Slightly bluish black | Bluish black | Bluish black | Bluish black | Bluish black | Bluish pitch black | Bluish black | Bluish black |
| | L* | 25 | 32 | 14 | 26 | 24 | 29 | 20 | 30 | 14 | 25 | 26 |
| | a* | −0.4 | −0.3 | −0.5 | −0.3 | −0.5 | −0.3 | −0.4 | −0.3 | −0.2 | −0.4 | −0.4 |
| | b* | −1.3 | −1.0 | −1.5 | −1.0 | −1.5 | −1.0 | −1.4 | −1.1 | −1.5 | −1.3 | −1.3 |
| | Color unevenness | A | A | A | A | A | A | A | A | A | A | A |
| Melt spinnability | | A | A | A | A | A | A | A | A | A | A | A |
| color fastness to rubbing (grade) | dry | 4-5 | 4-5 | 4-5 | 4-5 | 4-5 | 4-5 | 4-5 | 4-5 | 4-5 | 4-5 | 4-5 |
| | wet | 3-4 | 3-4 | 3-4 | 3-4 | 3-4 | 3-4 | 3-4 | 3-4 | 3-4 | 3-4 | 3-4 |
| Appearance | | A | A | A | A | A | A | A | A | A | A | A |
| Tactile impression | | A | A | A | A | A | A | A | A | B | A | A |

| | | Example No. | Com. Ex. 1 | Com. Ex. 2 | Com. Ex. 3 | Com. Ex. 4 | Com. Ex. 5 | Com. Ex. 6 |
|---|---|---|---|---|---|---|---|---|
| Ultrafine fibers | Resin Type | IP-modified PET | | | | | | |
| | Fineness (dtex) | 0.2 | 0.2 | 0.2 | 0.2 | 0.2 | 0.2 | |
| | Carbon black content ratio (mass %) | 1.5 | 5 | 1.5 | 1.5 | 1.5 | 0 | |
| | Type of chromatic pigment | Phthalocyanine-based organic blue pigment + Dioxazine-based organic purple pigment | | | | | Phthalocyanine-based organic blue pigment | |
| | Chromatic pigment content ratio (mass %) | 0 | 6.0 | 1.0 | 1.0 | 1.0 | 4.5 | |
| | Mass ratio of Chromatic pigment/CB | 0 | 1.20 | 0.67 | 0.67 | 0.67 | — | |
| | Total ratio of carbon black and chromatic pigment (mass %) | 1.5 | 11.0 | 2.5 | 2.5 | 2.5 | 4.5 | |
| Elastic polymer | Type | Aqueous polyurethane | | | | | | |
| | Content ratio (%) | 10 | 10 | 0 | 20 | 10 | 10 | |
| | Carbon black content ratio (mass %) | 0 | 0 | 0 | 0 | 0 | 0 | |
| Color | Color tone | Black | Dull greenish blue | Bluish black | Bluish black | Bluish black | Whitish blue | |
| | L* | 26 | 20 | 25 | 27 | 27 | 27 | |
| | a* | +1.0 | −3.2 | −0.4 | −0.4 | −0.4 | −10 | |
| | b* | +2.7 | −2.5 | −1.3 | −1.3 | −1.3 | −54 | |

TABLE 1-continued

| | | | | | | | |
|---|---|---|---|---|---|---|---|
| | Color unevenness | A | A | A | A | B | A |
| Melt spinnability | | A | B | A | A | A | B |
| color fastness to rubbing (grade) | dry | 4-5 | 4 | 4 | 4-5 | 4-5 | 3-4 |
| | wet | 3-4 | 3 | 3 | 3-4 | 3-4 | 2-3 |
| Appearance | | B | A | A | B | A | A |
| Tactile impression | | A | A | B | A | A | A |

Example 2

A napped artificial leather was obtained in the same manner as in Example 1 except that the island component resin in Example 1 was changed to an isophthalic acid-modified polyethylene terephthalate having a degree of modification of 6 mol % and to which 0.5 mass % of the carbon black and 0.3 mass % of the chromatic pigment had been added. Then, the obtained napped artificial leather was evaluated in the same manner as in Example 1. The results are shown in Table 1.

Example 3

A napped artificial leather was obtained in the same manner as in Example 1 except that the island component resin in Example 1 was changed to an isophthalic acid-modified polyethylene terephthalate having a degree of modification of 6 mol- and to which 5 mass % of the carbon black and 3.3 mass % of the chromatic pigment had been added. Then, the obtained napped artificial leather was evaluated in the same manner as in Example 1. The results are shown in Table 1.

Example 4

A napped artificial leather was obtained in the same manner as in Example 1 except that the amount of the chromatic pigment was changed from 1.0 mass % to 0.3 mass % in Example 1. Then, the obtained napped artificial leather was evaluated in the same manner as in Example 1. The results are shown in Table 1.

Example 5

A napped artificial leather was obtained in the same manner as in Example 1 except that the amount of the chromatic pigment was changed from 1.0 mass % to 3.0 mass % in Example 1. Then, the obtained napped artificial leather was evaluated in the same manner as in Example 1. The results are shown in Table 1.

Example 6

A napped artificial leather was obtained in the same manner as in Example 1 except that a fiber-entangled body that included fiber bundles each including 12 ultrafine fibers having a fineness of 0.1 dtex was used as the fiber-entangled body in Example 1. Then, the obtained napped artificial leather was evaluated in the same manner as in Example 1. The results are shown in Table 1.

Example 7

A napped artificial leather was obtained in the same manner as in Example 1 except that a fiber-entangled body that included fiber bundles each including 12 ultrafine fibers having a fineness of 0.3 dtex was used as the fiber-entangled body in Example 1. Then, the obtained napped artificial leather was evaluated in the same manner as in Example 1. The results are shown in Table 1.

Example 8

A napped artificial leather was obtained in the same manner as in Example 1 except that a fiber-entangled body that included fiber bundles each including 12 ultrafine fibers having a fineness of 0.3 dtex, and that contained an isophthalic acid-modified polyethylene terephthalate having a degree of modification of 6 mol % and to which 0.5 mass % of the carbon black and 0.3 mass % of the chromatic pigment had been added was used as the fiber-entangled body in Example 1. Then, the obtained napped artificial leather was evaluated in the same manner as in Example 1. The results are shown in Table 1.

Example 9

A napped artificial leather was obtained in the same manner as in Example 1 except that the fineness of the ultrafine fibers was changed to 1.5 dtex. Then, the obtained napped artificial leather was evaluated in the same manner as in Example 1. The results are shown in Table 1.

Example 10

A napped artificial leather was obtained in the same manner as in Example 1 except that the aqueous polyurethane was applied in an amount of 1 mass % instead of 10 mass % into the voids of the fiber-entangled body of the ultrafine fibers in Example 1. Then, the obtained napped artificial leather was evaluated in the same manner as in Example 1. The results are shown in Table 1.

Example 11

A napped artificial leather was obtained in the same manner as in Example 1 except that the aqueous polyurethane was applied in an amount of 15 mass % instead of 10 mass % into the voids of the fiber-entangled body of the ultrafine fibers in Example 1. Then, the obtained napped artificial leather was evaluated in the same manner as in Example 1. The results are shown in Table 1.

Comparative Example 1

A napped artificial leather was obtained in the same manner as in Example 1 except that no chromatic pigment was added in the ultrafine fibers. Then, the obtained napped artificial leather was evaluated in the same manner as in Example 1. The results are shown in Table 1.

Comparative Example 2

A napped artificial leather was obtained in the same manner as in Example 3 except that the chromatic pigment was added in an amount of 6.0 mass % instead of 3.3 mass % in the ultrafine fibers. Then, the obtained napped artificial leather was evaluated in the same manner as in Example 1. The results are shown in Table 1.

Comparative Example 3

A napped artificial leather was obtained in the same manner as in Example 1 except that the aqueous polyurethane was not applied into the voids of the fiber-entangled body of the ultrafine fibers in Example 1. Then, the obtained napped artificial leather was evaluated in the same manner as in Example 1. The results are shown in Table 1.

Comparative Example 4

A napped artificial leather was obtained in the same manner as in Example 1 except that the aqueous polyurethane was applied in an amount of 20 mass % instead of 10 mass % into the voids of the fiber-entangled body of the ultrafine fibers in Example 1. Then, the obtained napped artificial leather was evaluated in the same manner as in Example 1. The results are shown in Table 1.

Comparative Example 5

A napped artificial leather was obtained in the same manner as in Example 1 except that 5 mass % of the carbon black was added to the aqueous polyurethane impregnated into the voids of the fiber-entangled body of the ultrafine fibers to color the napped artificial leather in Example 1. Then, the obtained napped artificial leather was evaluated in the same manner as in Example 1. The results are shown in Table 1.

Comparative Example 6

A napped artificial leather was obtained in the same manner as in Example 1 except that the chromatic pigment in Example 1 was changed to an isophthalic acid-modified polyethylene terephthalate to which 4.5 mass % of a phthalocyanine-based organic blue pigment (copper phthalocyanine β crystal, Pigment Blue 15:3) had been added. Then, the obtained napped artificial leather was evaluated in the same manner as in Example 1. The results are shown in Table 1.

Referring to Table 1, all of the napped artificial leathers obtained in Examples 1 to 11 according to the present invention had a color fastness to rubbing of grade 4-5 or more in a dry state, and 3-4 or more in a wet state, and were colored in a wide variety of colors such as those having an L*value of 14 to 32. In addition, no color unevenness was observed on the napped surface, and no dichromatic impression was created in the appearance. On the other hand, in the case of the napped artificial leather obtained in Comparative Example 1, which contained no chromatic pigment, a dichromatic impression was created in the appearance. The napped artificial leather obtained in Comparative Example 2, in which the total ratio of the carbon black and the chromatic pigment was 11 mass %, exhibited poor melt spinnability. The napped artificial leather obtained in Comparative Example 3, which was not impregnated with the aqueous polyurethane, the surface had a rough tactile impression. In the case of the napped artificial leather obtained in Comparative Example 4, which was impregnated with 20 mass % of the aqueous polyurethane, a dichromatic impression was created in the appearance. In the case of the napped artificial leather obtained in Comparative Example 5, which was impregnated with the aqueous polyurethane to which 5 mass % of the carbon black had been added, a dichromatic impression due to black spots of the polyurethane was observed. Comparative Example 6, in which the isophthalic acid-modified polyethylene terephthalate to which 4.5 mass % of the chromatic pigment had been added was used alone without using carbon black, exhibited poor spinnability, had a whitish tone and thus was inferior in terms of the quality appearance, and also was inferior in terms of the color fastness to rubbing.

The invention claimed is:

1. A napped artificial leather, comprising:

a fiber-entangled body obtained by entangling ultrafine fibers; and an elastic polymer impregnated into the fiber-entangled body, the napped artificial leather having, on at least one side thereof, a napped surface formed by napping the ultrafine fibers, wherein the ultrafine fibers are fibers of at least one thermoelastic resin selected from the group consisting of an aromatic polyester, an aliphatic polyester, a nylon and a polyolefin, the ultrafine fibers comprise 0.2 to 8 mass % of carbon black and 0.1 to 5 mass % of a chromatic pigment, and a total ratio of the carbon black and the chromatic pigment is 0.3 to 10 mass %, a content ratio of the elastic polymer is 0.1 to 15 mass % in the napped artificial leather, and the elastic polymer is uncolored, and the ultrafine fibers are undyed.

2. The napped artificial leather according to claim 1, wherein a mass ratio of the chromatic pigment/the carbon black is 0.1 to 2.0.

3. The napped artificial leather according to claim 1, wherein the napped surface has a lightness L* value of 25 or less, an a* value in the range of −2.5 to 2.5, and a b* value in the range of −2.5 to 2.5 in a color coordinate space (L*a*b*color space).

4. The napped artificial leather according to claim 1, wherein the ultrafine fibers have an average fineness of 1.5 dtex or less.

5. The napped artificial leather according to claim 1, wherein the chromatic pigment comprises a phthalocyanine-based pigment.

6. The napped artificial leather according to claim 1, wherein the chromatic pigment comprises a dioxazine-based pigment.

7. A method for producing the napped artificial leather according to claim 1, comprising at least:

preparing a fiber-entangled body of island-in-the-sea conjugated fibers comprising, as an island component, at least one thermoplastic resin selected from the group consisting of an aromatic polyester, an aliphatic polyester, a nylon and a polyolefin comprising 0.2 to 8 mass % of carbon black and 0.1 to 5 mass % of a chromatic pigment, and a water-soluble thermoplastic resin as a sea component;

impregnating, into voids of the fiber-entangled body of the island-in-the-sea conjugated fibers, an aqueous liquid for forming an uncolored aqueous elastic polymer, and subsequently removing a part of the aqueous liquid by squeezing off, dry-coagulating the aqueous elastic polymer in the aqueous liquid impregnated into the voids of the fiber-entangled body of the island-in-the-sea conjugated fibers;

removing by dissolution the water-soluble thermoplastic resin from the island-in-the-sea conjugated fibers using an aqueous solvent, thereby obtaining an artificial leather gray fabric comprising the fiber-entangled body of the ultrafine fibers of the water-insoluble thermoplastic resin; and napping at least one side of the artificial leather gray fabric by buffing, wherein the method does not comprise dyeing the artificial leather gray fabric.

8. The method for producing the napped artificial leather according to claim 7, wherein a mass ratio of the chromatic pigment/the carbon black is 0.1 to 2.0.

9. The method for producing the napped artificial leather according to claim 7, wherein the ultrafine fibers have an average fineness of 1.5 dtex or less.

10. The method for producing the napped artificial leather according to claim 7, wherein the chromatic pigment comprises a phthalocyanine-based pigment.

11. The method for producing the napped artificial leather according to claim 7, wherein the chromatic pigment comprises a dioxazine-based pigment.

12. The napped artificial leather according to claim 1, wherein the elastic polymer comprises an aqueous elastic polymer.

13. The napped artificial leather according to claim 2, wherein the elastic polymer comprises an aqueous elastic polymer.

14. The napped artificial leather according to claim 3, wherein the elastic polymer comprises an aqueous elastic polymer.

15. The napped artificial leather according to claim 4, wherein the napped surface has a lightness L value of 25 or less, an a* value in the range of −2.5 to 2.5, and a b value in the range of −2.5 to 2.5 in a color coordinate space (L*a*b*color space), and the elastic polymer comprises an aqueous elastic polymer.

16. The napped artificial leather according to claim 5, wherein the napped surface has a lightness L* value of 25 or less, an a* value in the range of −2.5 to 2.5, and a b* value in the range of −2.5 to 2.5 in a color coordinate space (L*a*b* color space), and the elastic polymer comprises an aqueous elastic polymer.

17. The napped artificial leather according to claim 6, wherein the napped surface has a lightness L value of 25 or less, an a value in the range of −2.5 to 2.5, and a b* value in the range of −2.5 to 2.5 in a color coordinate space (L*a*b* color space), and the elastic polymer comprises an aqueous elastic polymer.

18. The napped artificial leather according to claim 1, wherein said chromatic pigment comprises a phthalocyanine-based pigment and a dioxazine-based pigment.

* * * * *